US005852976A

United States Patent [19]

Coudert

[11] Patent Number: 5,852,976

[45] Date of Patent: Dec. 29, 1998

[54] INSTALLATION AND A METHOD FOR DECORATING PROFILE STRIPS

[75] Inventor: Michel Coudert, Oyonnax, France

[73] Assignee: Grosfillex S.A.R.L., Oyonnax, France

[21] Appl. No.: 834,173

[22] Filed: Apr. 14, 1997

[30] Foreign Application Priority Data

Apr. 15, 1996 [FR] France ..... 96 04657

[51] Int. Cl.[6] ..... B41F 5/00

[52] U.S. Cl. ..... 107/216; 101/248; 101/328

[58] Field of Search ..... 101/484, 486, 101/212, 216, 328, 248, 230–232; 156/204; 428/13

[56] References Cited

U.S. PATENT DOCUMENTS 4,196,648 4/1980 Jones et al. .

4,460,429 7/1984 Coscia et al. .

*Primary Examiner*—Eugene Eickholt

*Attorney, Agent, or Firm*—Wolf, Greenfield & Sacks, P.C.

[57] ABSTRACT

An installation for decorating profiled strips comprises a conveyor suitable for transporting a plurality of strips, a separation station for separating the strips before they come onto the conveyor, and serving to place the strips in respective target positions in which they are spaced apart and parallel to the conveyor, a print station in which ink is applied to the surfaces of the strips, and a guide station disposed upstream from the print station and having spacer guides for the strips to constrain them to occupy their target positions before entering the print station. The method of decoration includes a step of separating the strips and of placing them in respective target positions, and a step of guiding the strips before printing on them.

12 Claims, 5 Drawing Sheets

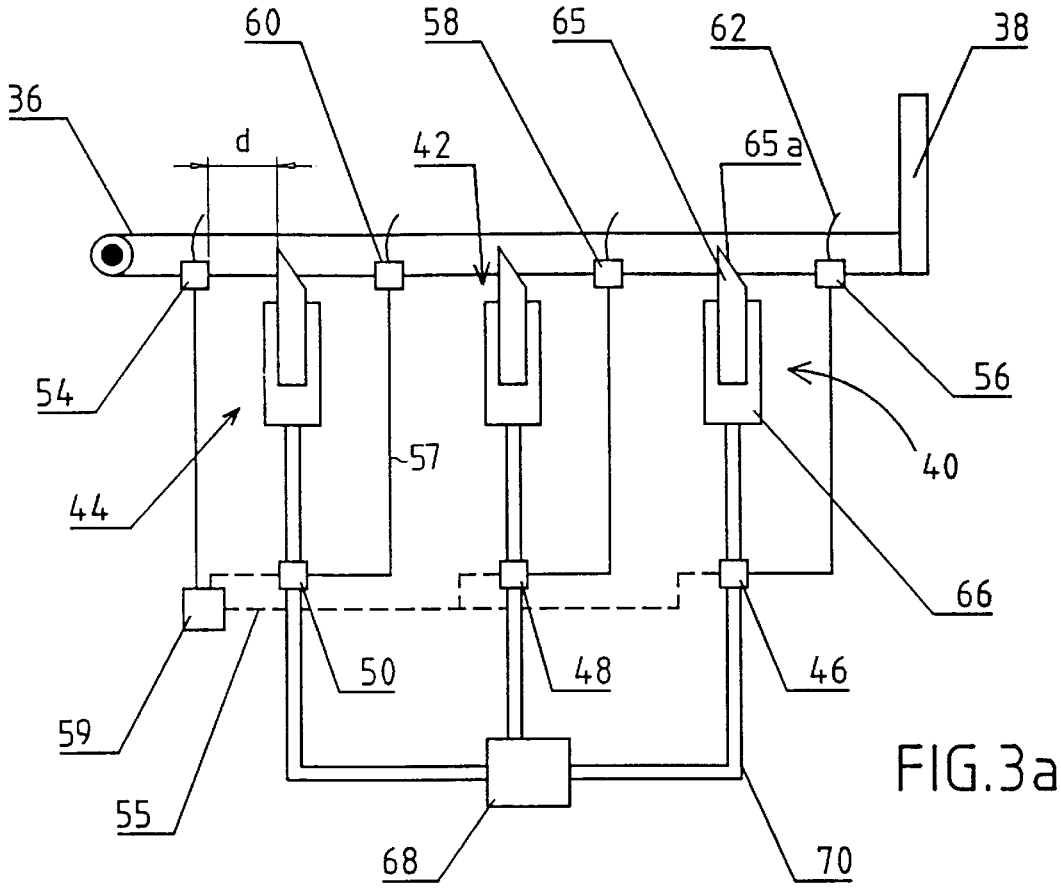
FIG.3a
FIG.3b
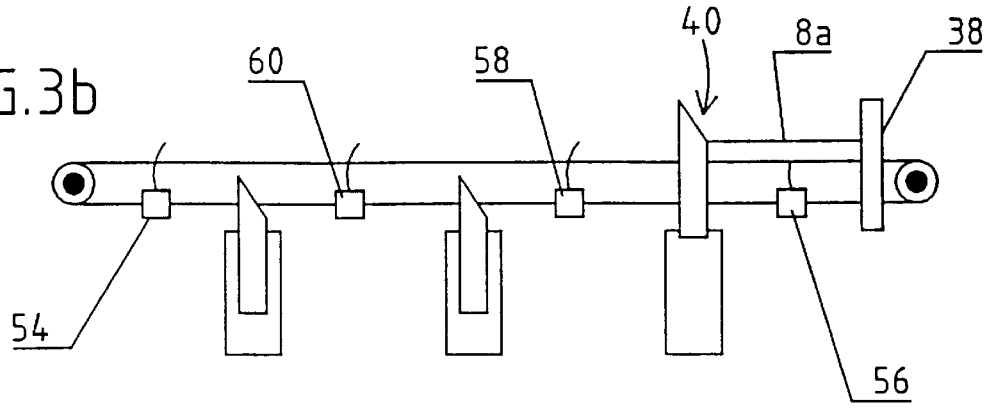
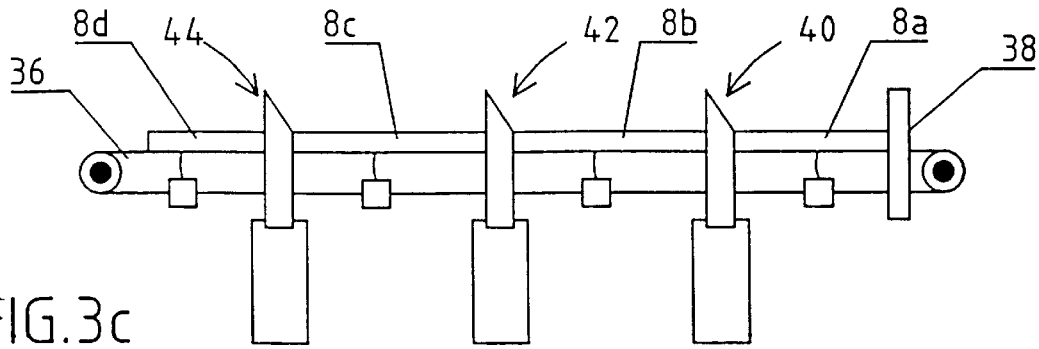
FIG.3c

INSTALLATION AND A METHOD FOR DECORATING PROFILE STRIPS

The present invention relates to an installation for decorating profiled strips, e.g. extruded plastic boards for covering a wall, the installation comprising a conveyor suitable for transporting a plurality of strips and a print station having at least one print unit suitable for applying ink to the surfaces of the strips.

BACKGROUND OF THE INVENTION

Known installations of this type generally serve to provide extremely simple decoration, mainly consisting in applying a generally uniform layer of ink on the surface of a strip, optionally together with shades of color disposed in more or less random manner. Such shades serve only to prevent the appearance of the decorated strips being monotonous.

With such known installations, it is practically impossible to distribute color in a geometrically organized and repetitive manner. In other words, those installations cannot be used to make defined and regular geometrical patterns on the surfaces of strips while simultaneously ensuring that the patterns are analogous and periodic in the same manner from one strip to another, e.g. to give a wall the appearance of being tiled.

This is due mainly to the fact that known installations cannot define the positions of strips relative to one another and relative to the print unit with the necessary accuracy.

OBJECTS AND SUMMARY OF THE INVENTION

The invention seeks to remedy those drawbacks and to propose an installation that makes it possible and easy to decorate profiled strips moved on the conveyor, even when making and repeating special geometrical patterns.

To this end, the installation of the invention includes a strip-separation station adjacent to the conveyor and disposed upstream therefrom, said separation station having both means for holding a plurality of strips in respective target positions, in which the strips are spaced apart, parallel, and disposed in such a manner that their longitudinal directions are parallel to the direction of advance of the conveyor, and means for bringing said strips occupying their target positions to the conveyor. The installation further includes at least one guide station disposed upstream from the print station on the path of the strips driven by the conveyor, said guide station comprising spacer means suitable for co-operating with the strips in the vicinity of the longitudinal edges thereof, so that said strips slide between said guides and are constrained to occupy their target positions prior to entering the print station.

The separation station serves to ensure the strips are properly prepositioned when they come on to the conveyor. Nevertheless, during that portion of their path that precedes their entry into the print station, the strips can become very slightly displaced. This is particularly true of strips which, before entering the print station, pass through a treatment station where they are subjected to brushing or to surface cleaning. However other effects, such as possible vibration of the conveyor, can also give rise to displacement of the strips. The passage of the strips through the guide station before they enter the print station enables their positioning to be monitored, and where necessary, enables them to be caused to return to their target positions.

The action of the guide station is simplified because of the prior positioning of the strips in the separation station, since the guide station needs only to be able to correct small positioning errors, if any, without being required, on its own, to achieve proper positioning starting from strips in a state where they are disposed in almost random manner on the conveyor.

Advantageously, the separation station includes transverse drive means suitable for exerting action on the profiled strips to displace them substantially perpendicularly to the direction of advance of the conveyor, and n series of stop means, n being an integer not less than 2. The first series being the series which, in the direction of advance of the transverse drive means, is located furthest downstream in the separation station, while the nth series is the series which, in the same direction, is located furthest upstream in said station. The stop means of two consecutive series are spaced apart from each other by a distance that is substantially equal to the width of a strip, the stop means of series 2 to n being suitable for occupying respective retracted positions in which they lie off the path of the strips through the separation station and respective active, abutment positions in which they lie on said path and are placed for co-operating with the strips. The separation station further includes n-1 actuator means for actuating the stop means of series 2 to n; the kth actuator means (k being an integer in the range 1 to n-1) is suitable for leaving the stop means of the k+1th series in the retracted position so long as no strip is present in the gap between the kth and the k+1th series, and for urging said stop means to take up their active, abutment position when a strip is in said gap. The separation station further includes longitudinal drive means suitable for acting on the strips to displace them parallel to the direction of advance of the conveyor and up to the conveyor, and takeover means suitable, when the strips are occupying their target positions in the separation stations, for causing the action of the transverse drive means on said strips to cease and for causing the action of the longitudinal drive means on said strips to begin.

It is advantageous for the installation to include coordination means for coordinating the positions of the strips before they enter the print station, said coordination means comprising retractable front stop members suitable for taking up a retracted position in which they do not engage the strips, and an active, abutment position in which they are suitable for coming into abutment with the leading ends of the strips and in which the occupy determined positions relative to one another, said coordination means further comprising control means for controlling the front stop members to move them between the retracted and the active positions.

The invention also relates to a method of decorating profiled strips, comprising transporting strips on a conveyor and applying ink to the surfaces of the strips by means of at least one print unit belonging to a print station.

Such known methods can generally be used only to make decoration that is extremely simple, consisting mainly in applying a generally uniform layer of ink to the surface of each strip together, optionally, with color shading disposed in more or less random manner.

Those methods do not enable the surfaces of strips to be covered in geometrical patterns that are well-defined and regular, and ensuring that the patterns are analogous and have the same periodicity from one strip to another.

The invention seeks to provide an improved method which facilitates decorating strips driven on the conveyor, even when marking repeated special geometrical patterns.

To this end, the method of the invention includes a step of separating strips and of placing a plurality of strips in respective target positions in which the strips are spaced apart, parallel, and disposed so that their longitudinal directions are parallel to the direction of advance of the conveyor, a step of bringing the strips in their target positions to the conveyor, and a step of guiding the strips as driven by the conveyor, upstream from the print station, the strips being guided by means of spacer guides suitable for co-operating with the strips in the vicinity of their longitudinal edges.

The separation step makes it possible to ensure that the strips are properly prepositioned when they come onto the conveyor. The step of guiding the strips, which is performed before the step of applying ink to the strips, serves to monitor the positioning of the strips and, where appropriate, to constrain them to return to their target positions.

Advantageously, the step of separating the strips includes a step of driving the strips transversely substantially perpendicularly to the direction of advance of the conveyor and upstream therefrom, a step of bringing n transversely-driven strips successively into abutment against n series of stop means, where n is an integer not less than 2 (the stop means in each series being parallel to the direction of advance of the conveyor), and a step of driving the strips longitudinally parallel to the direction of advance of the conveyor up to said conveyor.

It is also advantageous for the method to include a step of coordinating the positions of the strips before entry into the print station, which step comprises adjusting the positions of the leading ends of the strips relative to one another.

BRIEF DESCRIPTION OF THE DRAWINGS

The invention will be well understood and its advantages will appear more clearly on reading the following detailed description of an embodiment given by way of non-limiting example.

The description refers to the accompanying drawings, in which:

FIGS. 3*a* to 3*c* are diagrams showing how the separation station operates;

MORE DETAILED DESCRIPTION

Figure 1:
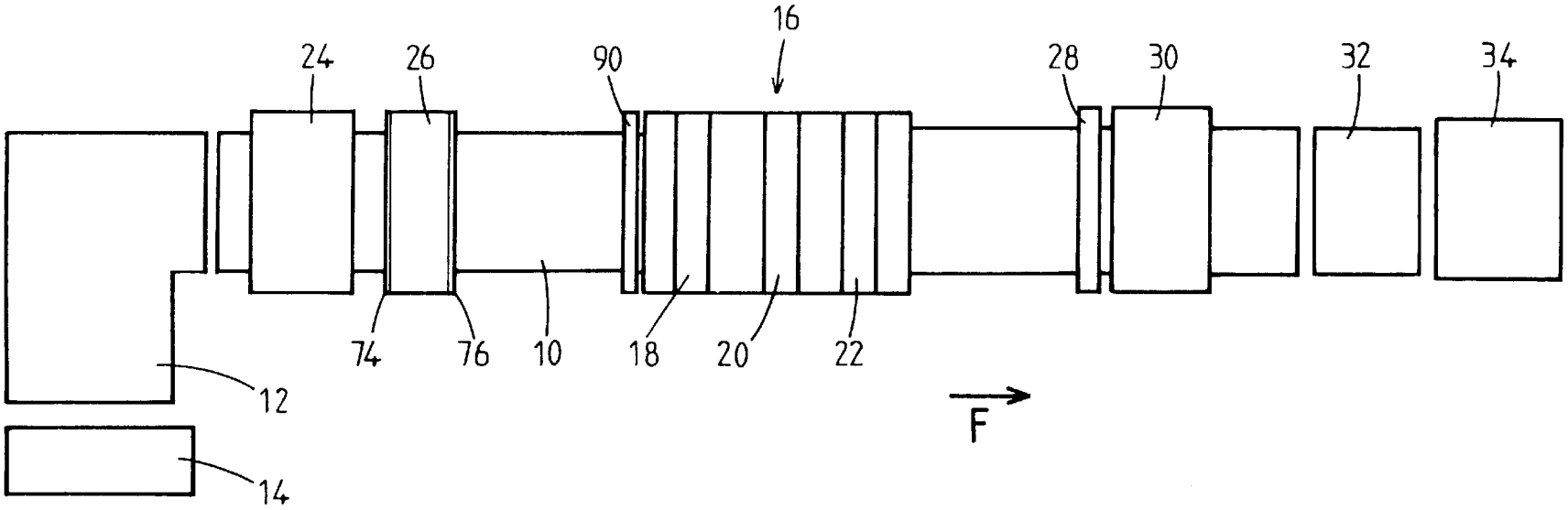
FIG. 1 is a general diagram constituting a plan view of an installation of the invention.

The installation of FIG. 1 is used for decorating profiled strips. Such strips are generally made by extruding a plastic material. They are used, for example, to cover surfaces such as walls and each presents a plane face that is intended to be apparent when the strip is in place, and sides fitted with complementary engagement means enabling the strips to be interconnected. On leaving the extruder, the strips are uniform in color, generally being white or gray. The installation of the invention serves to decorate the plane faces of the strips. Decoration may optionally include coloring said face and marking various patterns that may be geometrical, regular or otherwise. Thus, the patterns may imitate the appearance of tiling or of wood.

The installation comprises a conveyor 10 suitable for transporting a plurality of strips. The conveyor is generally in the form of a moving belt made up of one or more lengths on which the strips are placed, and enabling the strips to be conveyed through the various stations of the installation. The installation also includes a station 12 for separating the strips, which station is adjacent to the conveyor and upstream therefrom. The strips initially stored on a pallet 14 are inserted in succession into the separation station 12, possibly with the help of a pallet unloader, and said station 12 places the strips in respective target positions so that a plurality of strips are ready for feeding the conveyor. The outlet from the separation station is situated in the vicinity of the inlet of the conveyor 10. The installation includes, in particular, a print station 16 situated on the path of the conveyor and which has at least one print unit 18 serving to apply ink to the top faces of the strips passing through said station. In general, the print station has a plurality of print units disposed in succession on the path of the strip, each unit applying a different color. For example, the first unit 18 may put a background color on the surfaces of the strips, while units 20 and 22 operate in succession to apply two types of pattern of different colors.

Upstream from the print station, the installation may include a brushing station 24 in which the top faces of the strips are brushed and cleaned so as to constitute a medium ready to receive color in the print station.

The installation also includes a guide station 26 disposed upstream from the print station on the path of the strips driven by the conveyor. More precisely, the station 26 is situated, at least in part, downstream from the brushing station 24 and serves to correct the positions of the strips so that they reach the print station in their target positions. The processing to which the strips are subjected in the brushing station can cause them to move slightly and any such displacements must be corrected in the guide station. Whether the brushing station is present or not, it is advantageous to verify and optionally correct the positioning of the strips prior to the print station, thus making the guide station 26 necessary.

Downstream from the print station 16, the installation includes one or more varnishing stations 28 and a varnish-fixing station 30, e.g. using ultraviolet radiation.

At the outlet from the conveyor, the installation includes a transfer system 32 which serves to load the decorated strips onto pallets 34.

There follows a description of the strip separation station with reference to FIGS. 2 and 3*a* to 3*c*. This station comprises means for maintaining a plurality of strips in target positions, in which they are spaced apart, parallel, and disposed in such a manner that their longitudinal directions D are parallel to the direction of advance F of the conveyor 10. This separation station also includes means for acting on the strips once in their target positions, to bring them up to the conveyor.

Figure 2:
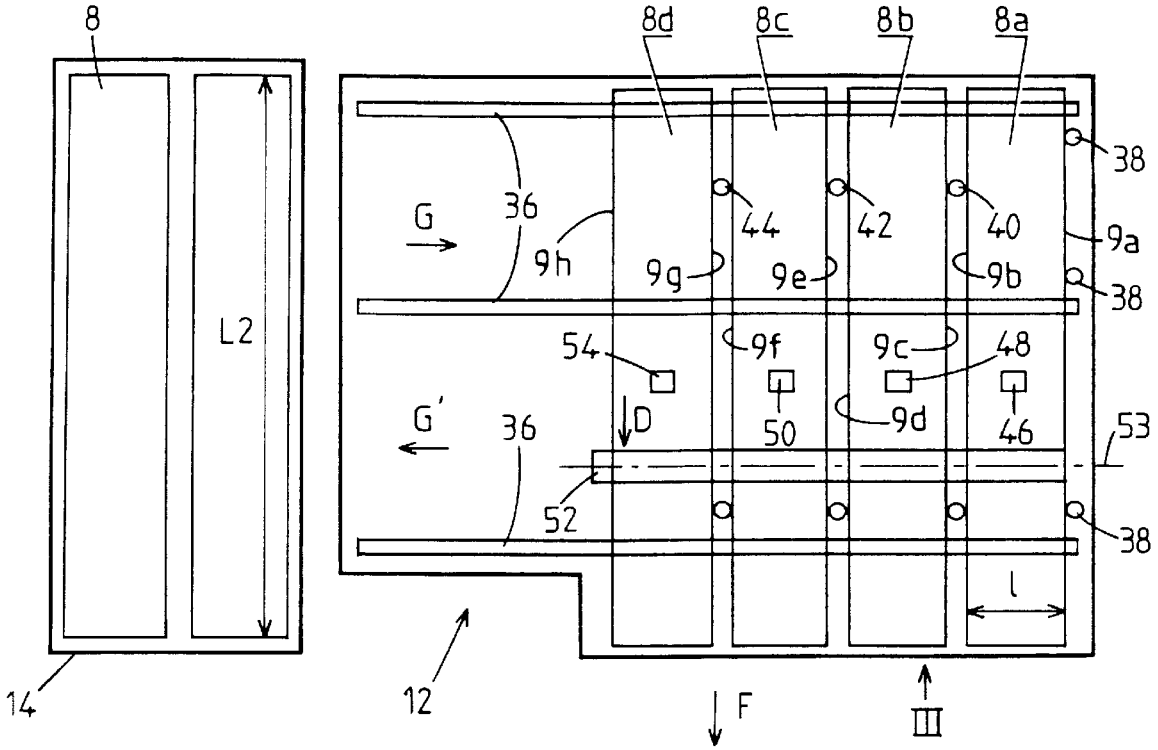
FIG. 2 shows the strip separation station, likewise in diagrammatic plan view.

More precisely, the separation station includes transverse drive means suitable for exerting action on the strips to separate them in a direction G substantially perpendicular to the direction of advance F of the conveyor. In FIG. 2, strips 8 are still disposed on the pallet 14 upstream from the separation station, and four strips 8*a*, 8*b*, 8*c*, and 8*d* are disposed in this station in their target positions. The transverse drive means comprise belts 36 that are parallel to one another and perpendicular to the conveyor. The strips unloaded from the pallet are thus placed on the belts 36 which drive them towards the downstream edge of the separation station remote from its inlet.

To place and hold the strips in their target positions, the separation station includes several series of stop means. The stop means in the first series are close to the downstream edge of the station. By way of example, they may be constituted by a plurality of vertical rollers 38 free to rotate about their respective axes but fixed vertically, and against which one of the longitudinal edges 9*a* of the first strip 8*a* comes into abutment. Naturally, the rollers 38 are in alignment on the direction F of conveyor displacement.

The other series of stop means are disposed in succession in the direction G' opposite to the direction G.

In the example shown, the separation station includes four series of stop means capable of holding four strips in their target positions. The stop means of the series 1 to 4 are given respective references 38, 40, 42, and 44.

The stop means 38 of the first series co-operate with the first longitudinal edge 9*a* of the first strip 8*a,* while the stop means 40 of the second series cooperate with the second longitudinal edge 9*b* of the first strip 9*a* and with the first longitudinal edge 9*c* of the second strip 8*b*. Similarly, the stop means 42 of the third series co-operate with the second longitudinal edge 9*d* of the second strip 8*b* and with the first longitudinal edge 9*e* of the third strip 8*c,* while the stop means 44 of the fourth series co-operate with the second edge 9*f* of the third strip 8*c* and with the first edge 9*g* of the fourth strip 8*d*. It would also be possible to provide a fifth series of stop means to co-operate with the second edge 9*h* of the fourth strip 8*d*. However that is not always necessary.

In general, the separation station comprises n series of stop means, n being an integer not less than two. The first series is the series which, in the direction of advance G of the transverse drive means 36 is located furthest downstream in the separation station. The nth series is the series which, in the direction G is furthest upstream in the separation station, i.e. the closest to its inlet. The stop means of two consecutive series are spaced apart from each other by a distance substantially equal to the width l of a strip.

It is mentioned above that the stop means 38 of the first series are fixed vertically. In contrast, the stop means of series 2 to n are suitable for taking up respective retracted positions in which they are off the path of the strips through the separation station, and respective active stop position in which they lie on said path and are placed to co-operate with the strips.

FIG. 3*a* is a diagrammatic view seen in direction III of FIG. 2. In this figure, the stop means 40, 42, and 44 of series 2 to 4 are all in their retracted positions, i.e. they are located vertically beneath the top faces of the belts 36 on which the strips can be placed. In contrast, in FIG. 3*c,* which is a view in a direction analogous to that of FIG. 3*a,* all of the stop means 40, 42, and 44 are in their active or stop positions and they are co-operating with strips 8*a,* 8*b,* 8*c,* and 8*d*.

The separation station 12 also includes n-1 actuator means for actuating the stop means of series 2 to n. These actuator means are respectively numbered 46, 48, and 50.

The actuator means operate as follows. The kth actuator means (k being an integer in the range 1 to n-1) is suitable for leaving the stop means of the k+1th series in the retracted position so long as no strip is present in the gap between the kth the k+1th series, and is suitable for urging said stop means into their active or stop position when there is a strip in said gap.

For example, it can be seen in FIG. 3*a,* that the stop means 40 of the second series are occupying their inactive position and that no strip is present in the gap between the stop means 38 and 40. However, in FIG. 3*b,* a strip 8*a* is situated in said gap, and the first actuator means 46 has urged the stop means 40 of the second series into their active position, such that the first strip 8*a* is held in abutment between the means 38 of the first series and the means 40 of the second series. In contrast, there is no strip in the gap between the second and third series of stop means 40 and 42, and the stop means of the third series are still in their inactive position. When a strip is to be found in said gap, then the second actuator means 48 urge the stop means 42 into their active position.

The stop means 38, 40, 42, and 44 thus serve to hold the strips in their target positions. When they are in these positions and when all of the stop means are active, the strips, now in their target positions, are brought to the conveyor. To this end, the separator station includes longitudinal drive means which exert drive on the strips to displace them parallel to the direction of advance F of the conveyor so as to bring them to the conveyor. To implement the longitudinal drive means, the separation station includes takeover means which, when the strips are in their target positions in said station, are capable of causing the transverse drive means to cease having an effect on the strips and to begin the action of the longitudinal drive means.

In the example shown, the longitudinal drive means include at least one drive roller 52 mounted to rotate about an axis 53 parallel to the direction G. In a first variant, this roller 52 can be driven continuously at the same speed as the speed of advance of the conveyor 10. Under such circumstances, it may occupy a retracted position, e.g. beneath the horizontal level of the horizontal transport belts 36 while the separation station is being fed with strips and the strips are being placed in their target positions. The takeover means then include a system capable, once the strips are in their target positions, of displacing the roller 52 vertically so as to raise it into contact with the bottom faces of the strips, thereby causing the strips to advance in the longitudinal direction F. The action of the roller 52 on the strips then overrides the action of the belts 36. There is therefore no need to stop the belts 36 from moving or to displace them to prevent them acting on the strips. This system for vertically displacing the roller may be of any type, e.g. hydraulic or mechanical.

In a second variant, the roller 52 may be situated constantly at the same horizontal level as the belts 36, but it may be stopped so long as the strips have not reached their target positions. Under such circumstances, the takeover means comprise, for example, a clutch system serving to impart rotary drive to the roller 52 when the strips are in their target positions, thereby enabling the strips to be advanced in the direction F. In this case also, there is no need to stop the belts 36 from moving in order to stop them acting on the strips.

In either variant, the takeover means advantageously include a detector for detecting the presence of a strip upstream from the nth series of stop means, with such a detector being given reference 54 in the figures. Naturally, it is offset by a distance d from the stop means of the nth series (the distance d being measured parallel to the direction G), which distance d is shorter than the width l of one strip. The detector 54 is connected to actuator means for the takeover means, e.g. to means for controlling vertical displacement of the roller 52, and thus enables the action of the roller 52 on the strip to be started as soon as the last strip is in place. The actuator means are represented diagrammatically by a unit 59 in FIG. 3*a*.

Advantageously, the actuator means for the moving stop means 40, 42, and 44 of series 2 to n include detectors analogous to the detector 54 and respectively referenced 56, 58, and 60. The detectors can be constituted by photocells or electro-pneumatic sensors capable of issuing signals indicative of the presence of strips and thus causing the actuator means for displacing the stop means to be brought into operation.

Nevertheless, in the example shown, the detectors are constituted by feelers 62 whose positions are affected by the presence of strips.

Vertical displacement of the stop means may be under pneumatic control. More precisely, each stop means may be constituted by a piston 65 that is vertically movable relative to a cylinder 66 connected to a source of compressed air 68 via an air duct 70. The actuator means may be interposed on the ducts 70 connecting the source of compressed air to each of the cylinders, and they may be constituted by respective valves which are closed so long as no strip has been detected, and opened on receiving a control signal as transmitted by a line 57 connected to a respective detector, when the detector observes the presence of a strip. Naturally, other actuator means may also be used.

In general, the actuator means may be connected to detectors of the presence of the strips situated in each of the gaps between two consecutive series of stop means, and may comprise means for displacing the stop means in each series between the retracted position and the active position, and means for controlling said displacement means, connected to the presence detectors.

The separation station also includes means for retracting the retractable stop means of series 2 to n after the strips have left this station.

To this end, the actuator means 46, 48, and 50 may all be connected to a manually operated control system. Nevertheless, if the detector for detecting the presence of the nth strip is provided, then retraction of the stop means in series 2 to n can likewise be under the control of said detector.

Thus, in the example shown, lines 55 connect the actuator means 46, 48 and 50 to the unit 59. As mentioned above, the unit can thus activate drive by means of the roller 52. The unit may also, for example by expiry of a given time lapse after a signal has been received from the detector 54, cause the actuator means 46, 58, and 50 to be driven in the direction for retracting the stop means 40, 42, and 44.

In FIGS. 3*a* to 3*c*, it can be seen that the top ends of the pistons 65 of the retractable stop means are tapered. These pistons thus constitute separator ramps 65*a* that advantageously have their high ends on the upstream side in the direction of advance of the transverse drive means, thus enabling two strips to be moved apart if they are too close together.

In the example shown, each series includes a plurality of stop means constituted by different members. It would also be possible to have only one stop means per series, implemented in the form of an elongate member extending parallel to the direction F.

Figure 4:
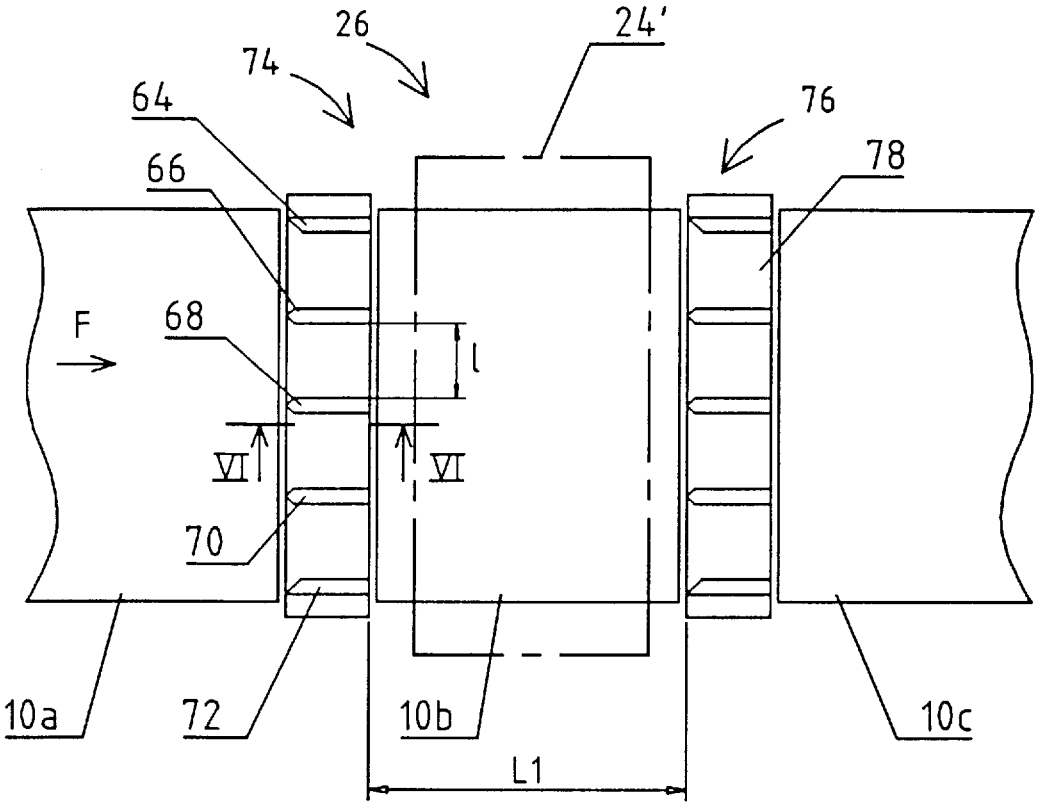
FIG. 4 is a plan view of a guide station.
Figure 6:
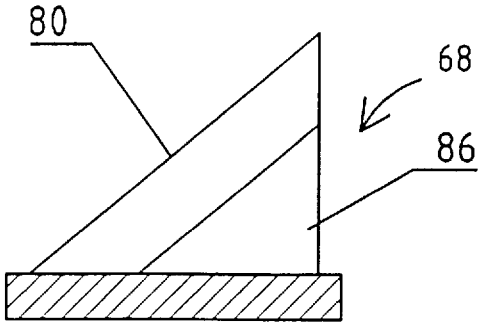
FIGS. 5 and 6 show a spacer guide, respectively end-on and from the side.
Figure 5:
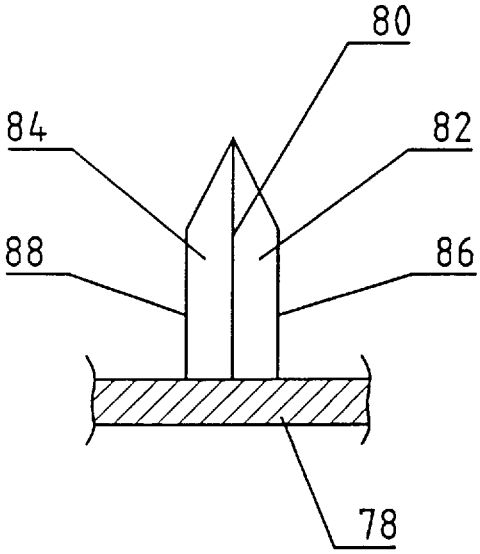

With reference to FIGS. 4 to 6, there follows a description of the guide station 26. It includes spacer guides 64, 66, 68, 70, and 72 suitable for co-operating with the strips, in the vicinity of their longitudinal edges, so that said strips slide between the guides and are thus constrained to occupy their target positions before entering into the print station 16. The spacing between two consecutive spacer guides is substantially equal to the width l of a strip. If, as mentioned above, the separator station has n series of stop means, then the guide station advantageously includes n+1 spacer guides in alignment across the conveyor. The guide 64 may co-operate with the first longitudinal edge 9*a* of the first strip 8*a*, while the guide 66 may co-operate with the second edge 9*b* of the first strip 8*a* and with the first edge 9*c* of the second strip 8*b*. Finally, the guide 72 may co-operate with the second edge 9*a* of the last strip 8*d*.

The guide station 26 advantageously includes at least one first series and one second series of spacer guides respectively referenced 74 and 76 in FIG. 2. The guides in the two series are analogous. The guides in each series are in alignment across the direction of advance F of the conveyor. In addition, the second series has as many spacer guides as the first. More precisely, each guide in either series corresponds to a guide in the other series and is in alignment therewith in the direction of advance F of the conveyor. The distance L1 between the two series of guides 74 and 76 as measured parallel to the direction F is less than the length L2 of the strips (see FIG. 2). Thus, when the strips pass between the spacer guides, it is possible for them to be guided simultaneously at two distinct locations along their length. This ensures that they extend in directions that are exactly parallel to the direction F.

It is possible to have only one series of guides, with the distance thereof from the last stop means of the separation station being less than the length of a strip.

As mentioned above, the brushing station 24 can be disposed upstream from the guide station 26. Nevertheless, as indicated by reference 24' in FIG. 4, the brushing station may be disposed between the two series of guides 74 and 76. At this location, there may also be situated a preprint station or, more generally, a station for preparing the services of the strips.

Still with reference to FIG. 4, it can be observed that the series of spacer guides occupy gaps in the conveyor. More precisely, the conveyor may have a first length 10*a* situated upstream from the first series 74, a second length 10*b* situated between the two series, and a third length 10*c* situated downstream from the second series 76. The length 10*c* may extend as far as the downstream end of the installation, or no further than the inlet to the print station 16, in which case it is followed by one or more other lengths. By means of these dispositions, the spacer guides can be fixed to bars 78 that extend transversely relative to the direction of advance F, that are vertically fixed, and that are located in the gaps between the lengths 10*a* and 10*b* or 10*b* and 10*c*, as the case may be.

As can be seen in FIGS. 4 to 6, the spacer guides advantageously have narrow upstream ends and flare downstream in the direction of advance F of the conveyor. FIGS. 5 and 6 show the guide 68 by way of example. Its upstream edge 80 is constituted by a sloping edge raised at its downstream end. Two faces 82 and 84 flare downstream from said edge to respective vertical facets 86 and 88. By means of this shape, the spacer guides have a natural tendency to move the strips apart if they are too close to one another in the guide station. Since the edge 80 is sloping, the strips can be properly spaced apart even if they are lifted slightly above the conveyor 10.

The station advantageously includes means for coordinating the positions of the strips before they enter into the print station. In FIG. 1, these means are given overall reference 90 and they are shown in greater detail, although still diagrammatically, in FIG. 7. In this figure, there can be seen the downstream portion of the length 10*c* of the conveyor together with the upstream portion of a following length 10*d*. For simplification purposes, only the first print unit 92 of the print station 16 is shown diagrammatically. It includes an ink tank 94 represented by chain-dotted lines, a rotary print cylinder 96, and a backing and ink-spreading cylinder 98. The cylinder 96 is rotated at a tangential speed equal to the speed of advance of the conveyor 10.

The means for coordinating the positions of the strips prior to entry into the print station 16 comprise retractable front stop members 100, 102, 104, and 106 suitable for taking up a retracted position in which they do not stop the strips, and an active, stop position (shown in FIG. 7) in which they are placed so as to come into abutment with the leading ends 7*a*, 7*b*, 7*c*, and 7*d* of the strips 8*a*, 8*b*, 8*c*, and 8*d*, and in which they occupy determined positions relative to one another. The coordination means also include means 108 for controlling the front stop members to move them between their retracted and active positions.

For example, the retracted position of the front stop members may be a position in which they are raised relative to the conveyor so that the strips pass under the stop members without touching them. The means for controlling the stop members are then capable of lowering them so as to bring them into a position in which they are close enough to the conveyor to stop the strips. Naturally, it would also be possible to design these stop members in the same way as the stop members of the separation station, in which case their retracted position would be a position in which they are below the horizontal level of the conveyor and they would be raised a little to occupy the active position. The advantage of the configuration shown in FIG. 7 lies in the fact that it is compatible with implementing the length 10*c* of the conveyor in the form of a continuous belt.

Figure 7:
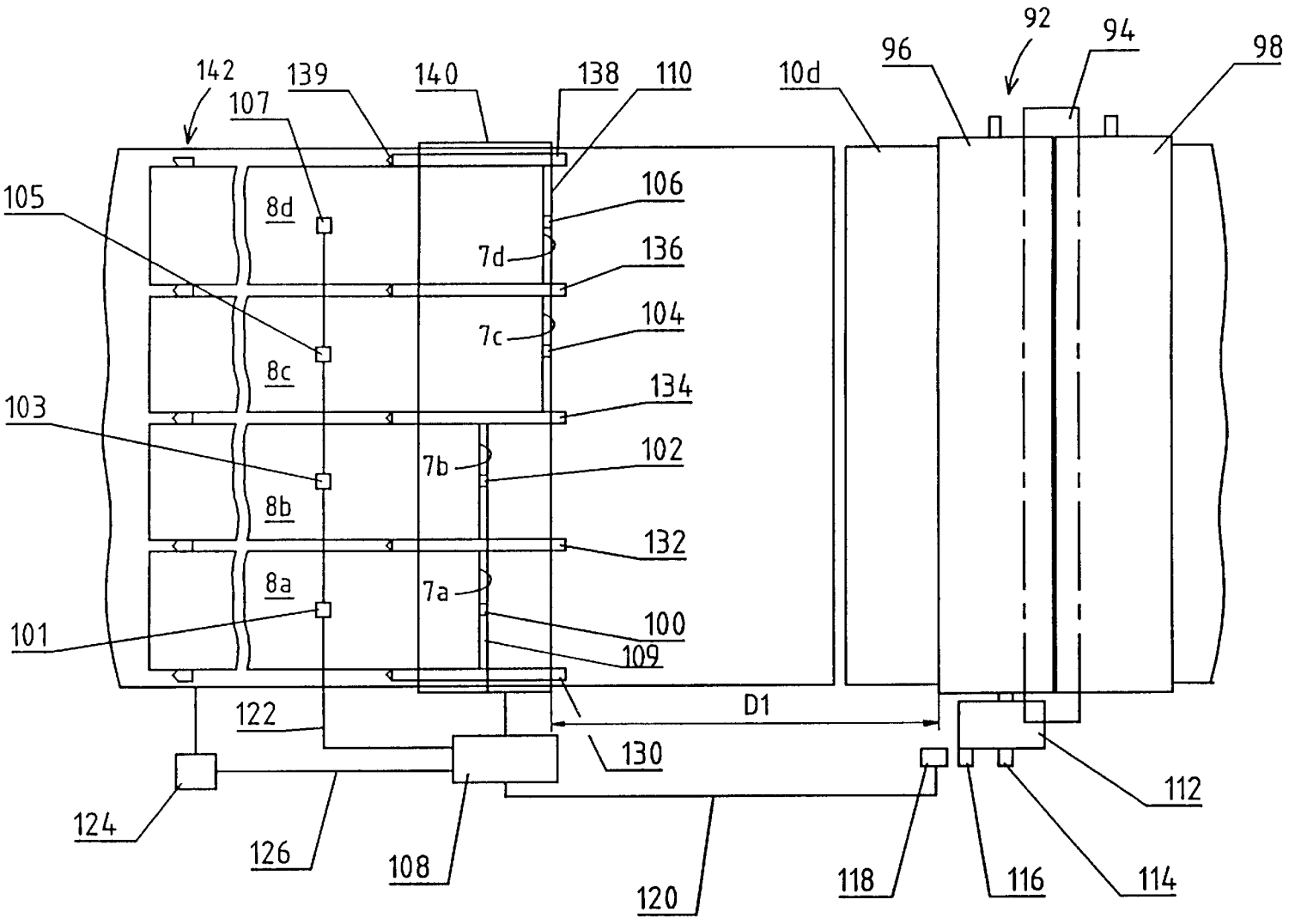
FIG. 7 shows the strip position coordination means.

The front stop members may, as shown in FIG. 7, be constituted by separate members each co-operating with the leading edge of a respective strip. They can thus be mounted independently of one another or in pairs (as in the example shown) on means for adjusting their longitudinal positions, and suitable for being displaced horizontally parallel to the direction of advance of the conveyor. Thus, in the example shown, the front stop members 100 and 102 are mounted on a first transverse bar 109 while the stop members 104 and 106 are mounted on a second transverse bar 110. Both of these bars, or only one of them, can be mounted to be movable so as to enable the positions of the members 100 & 102 or the position of the members 104 & 106 to be adjusted, thereby offsetting the strips relative to one another. This makes it possible to obtain patterns on the strips that are themselves offset, even if the marks on the printing cylinder are not offset.

Nevertheless, the front stop members may also be constituted by a single upstream face of a single bar extending transversely relative to the direction F. In which case, it is not possible to adjust the offset of various strips relative to one another. If it is then desired to obtain patterns that are offset, this must be done by offsetting the marking on the print cylinder.

The use of coordination means makes it possible to determine exactly the relative positions of the leading edges of the various strips present on the conveyor. Advantageously, the coordination means also serve to synchronize the advance of the strips with the rotation of the print cylinder 96. For this purpose, the installation includes reference means serving to identify at least one angular position of the print cylinder, and means for transmitting a reference signal to the control means 108 controlling the front stop members. In the example shown, a disk 112 is secured to the shaft 114 of the cylinder 96. The disk carries a reference mark 116 in a determined zone of its periphery. A proximity detector 118 is placed in the vicinity of the disk. Thus, when the mark 116 comes close to the detector 118 during rotation of the cylinder 96, a signal is transmitted to the control means 108 via the transmission means 120. If, on receiving said signal, the front stop means are in the active or stop position, and if all of the strips are, at that moment, present in abutment against the stop members, then the control means 108 can retract the stop members so that all of the strips can begin to advance simultaneously and so that they all reach the print cylinder 96 at respective moments corresponding to known angular positions of the cylinder such that the patterns made in the print station can all begin at determined locations on the strips relative to their leading edges.

To facilitate this operation, the coordination means advantageously include means for detecting the presence of the strips in the region of the conveyor situated in the vicinity of and upstream from the front stop members while they are in their active positions. In addition, the coordination means include means for transmitting detection signals issued by the detection means to the control means 108 controlling the front stop members. FIG. 7 shows the possible locations of such detector means implemented in the form of sensors that may be analogous to the sensors in the separation station. The sensors are connected to the control means 108 by transmission means 122. These control means 108 can thus cause the stop members to be retracted when the sensors and the detector 118 simultaneously provide the detection signals and the reference signal.

The coordination means can therefore operate as follows. Starting from an initial state in which the front stop members are retracted, the control means 108 can urge said stop members into their active positions. Nevertheless, if one of the sensors 101 to 107 detects the presence of a strip, it prevents the stop members being put into the active positions so as to prevent them damaging a strip present on the conveyor 10*c*. Under such circumstances, the detection signal transmitted to the control means 108 prevent the stop members being put into the active position. However, if no strip is detected, then the absence of a detection signal or the transmission of a non-detection signal to the control means enable the control means to urge the stop members into the active position. Thereafter, the various strips present on the conveyor naturally come into abutment against the stop members.

When, starting from this situation, the detector 118 detects that the print cylinder is in an angular position suitable for allowing the strips to advance, a reference signal is applied to the control means 108 which can then cause the stop members to be retracted.

In a first variant, the conveyor can continue to move while all these operations are taking place. In which case, the length 10*c* can extend continuously and without interruption in front of the print station. Nevertheless, in an advantageous variant, advantage is taken of means for controlling the conveyor that are suitable for causing the conveyor to advance or to stop, or at least for advancing or stopping the length 10*c* thereof.

By way of example, these means which may be constituted by a brake system or by a clutch system, and they are symbolized in FIG. 7 by a unit referenced 124. In this case, the installation includes means 126 for transmitting to the control means 124 a detection signal as emitted by the detection means in the presence of the strips (sensors 101, 103, 105, 107) and a reference signal emitted by the reference means (reference mark 116 and proximity sensor 118), together with a signal indicating the position (retracted or active) of the front stop members. These transmission means may be constituted by any type of electric line, infrared transmission, etc. To simplify FIG. 7, transmission lines are shown connecting the various means for detecting the presence of the strips, for identifying the reference angular position of the cylinder, and for controlling the conveyor to the means 108 for controlling the front stop members.

Because of these dispositions, the control means 124 for controlling the conveyor are suitable for stopping the conveyor or more specifically the length 10*c* thereof whenever the front stop members are in the active position and the detection means (101, 103, 105, and 107) detect the presence of strips, which means that the strips are indeed in abutment against the front stop means. Thereafter, it is only on reception of the reference signal emitted by the reference means that the conveyor is started up again and the stop means are retracted. This makes it possible to avoid any skidding of the strips relative to the conveyor while the stop means are being retracted. This ensures that the respective positions thereof are not modified relative to one another in any way on this occasion.

The distance D1 between the leading strips and the print cylinder 96 is determined so that the path travelled by the strips after the stop means have been retracted is long enough (as a function of the acceleration of the conveyor after being restarted by the control means 124) to ensure that the speed of these strips on reaching the print cylinder is equal to the constant tangential speed of the cylinder. The length 10*c* of the conveyor preferably comes to an end a little way upstream from the print station, with the print station having a further length 10*d* of the conveyor, thereby ensuring that stopping the length 10*c* has no effect on movement of strips downstream therefrom.

When the strips are coordinated prior to entering the print station, guidance of the strips may also be verified or corrected. For this purpose, lengths of guide rail 130, 132, 134, 136, and 138 may also be provided in the vicinity of the front stop members for co-operating with the longitudinal edges of the strips close to their leading ends. Advantageously, these guide rail lengths are constrained to move with the front stop members. For example, they may be mounted on a common vertically movable frame 140 under the control of the control means 108. The upstream edges 139 of the lengths of rail may be tapered, or indeed they may be generally analogous to the upstream edges of the spacer guides as described above with reference to FIGS. 4 to 6. It is also possible to place a series 142 of such spacer guides upstream from the rail lengths, so as to co-operate with the longitudinal edges of the strips in the vicinity of their trailing ends so as to position the strips parallel to the direction of advance of the conveyor along the full length of the strips.

While the top faces of the strips are being printed, the strips may be subject to small relative displacements. To prevent such displacement spoiling the repeating patterns printed by the print station, the installation advantageously includes means for guidance tweaking in the region of this station 16.

Advantageously, when the print station includes at least two successive print units in the direction of advance of the conveyor, the guidance tweaking means are situated between the two print units.

Figure 8:
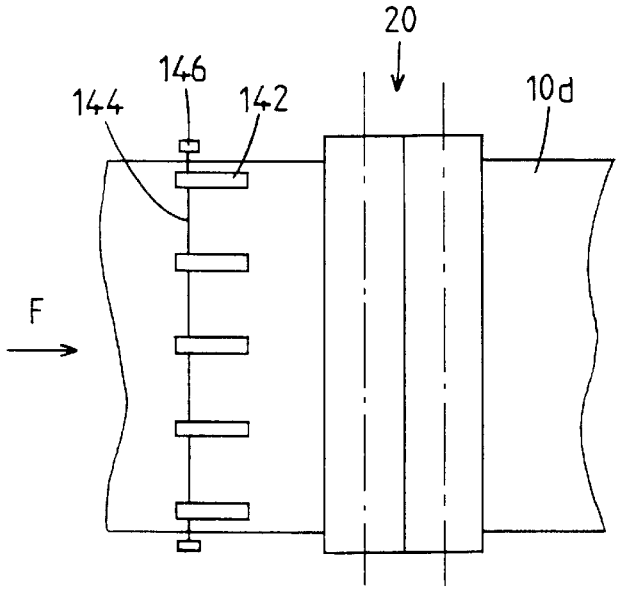
FIG. 8 shows means for tweaking strip guidance.

FIG. 8 shows an embodiment of such guidance tweaking means disposed upstream from the second print unit 20 and downstream from the first print unit 18 (not shown). Insofar as the guidance tweaking means are very close to the print station, or indeed inside it, it is important to avoid them being too coercive since the quality of printing could be spoilt by the strips being put into position too roughly.

In the example of FIG. 8, the tweaking means comprise a plurality of cylinders 142. Preferably, there are as many cylinders 142 as there are rail lengths or spacer guides in a series. The axes of the cylinders 142 are parallel to the direction of advance F of the conveyor. In the vicinity of their leading ends, the cylinders are mounted on a bar 144 extending transversely and mounted on bearings 146 so as to be capable of pivoting freely. In contrast, the trailing ends of the cylinders rest naturally on the conveyor.

Thus, when the strips come into the vicinity of the cylinders 142, they can normally pass between them, however if they have shifted during printing, then they are put back into place. When a shifted strip comes into the vicinity of a cylinder, the cylinder is free to lift slightly so that its convex face co-operates with the longitudinal edge of the strip, thereby putting it back into place progressively. The generic term "cylinder" is used to designate the elements 142, but it should be understood that these cylinders may be entire or fragmentary or that any equivalent element could be used that has a convex face, or indeed it would be possible to use wheels that are shaped appropriately.

In the method of the invention for decorating profiled strips, the step of separating the strips serves to place them in respective target positions in which they are spaced apart and parallel to the direction of advance F of the conveyor 10. These target positions are conserved while the strips are being brought up to the conveyor and the strips are guided upstream from the print station during a guide step so as to ensure that they still occupy their target positions, and so as to correct their positions if they do not.

As mentioned above with reference to FIG. 4, the step of guiding the strips advantageously makes use of two series of guides that are spaced apart in the direction of advance of the conveyor by a distance that is shorter than the length L2 of the strips.

For separation purposes and to place them in the target positions, the strips are initially driven transversely, and n strips successively come into abutment against n series of stop means. The stop means in each series are aligned parallel to the direction of advance F of the conveyor. When the n strips are in abutment in their target positions, there comes the step of driving said strips longitudinally to the conveyor. The method advantageously includes a step of coordinating the positions of the strips before they enter into the print station 16. This step includes adjusting the positions of the leading ends of the strips relative to one another, e.g. by means of retractable stop means.

During the step of applying ink to the strips, the surfaces of the strips come into contact with a rotary print cylinder 96 belong to the print unit. At this point, the method advantageously includes a step of synchronizing the arrival of the strips so that they come into contact with the rotary cylinder appropriately relative to the angular position thereof. This synchronizing step includes identifying a reference angular position of the cylinder, and controlling advance of the strips, e.g. by retracting the front stop means and, optionally, by restarting advance of the previously stopped conveyor.

The synchronization step can then include stopping the conveyor when the positions of the leading edges of the strips are adjusted relative to one another (while said ends are co-operating with the stop means), and restarting advance of the conveyor as a function of the angular position of the rotary print cylinder.

I claim:

1. An installation for decorating profiled strips, the installation comprising a conveyor suitable for transporting a plurality of strips and a print station having at least one print unit suitable for applying ink to the surfaces of the strips, the installation including:

a strip-separation station adjacent to the conveyor and disposed upstream therefrom, said separation station having both means for holding a plurality of strips in respective target positions, in which the strips are spaced apart, parallel, and disposed in such a manner that their longitudinal directions are parallel to the direction of advance of the conveyor, and means for bringing said strips occupying their target positions to the conveyor; and at least one guide station disposed upstream from the print station on the path of the strips driven by the conveyor, said guide station comprising spacer guides suitable for co-operating with the strips in the vicinity of the longitudinal edges thereof, so that said strips slide between said space guides and are constrained to occupy their target positions prior to entering the print station.

2. An installation according to claim 1, wherein:

the guide station includes at least a first and a second series of spacer guides, the spacer guides in each series being aligned across the direction of advance of the conveyor;

each spacer guide of one of the first and second series corresponds to a guide in the other one of said series, said corresponding guides being in alignment in the direction of advance of the conveyor; and the distance between the two series of guides as measured parallel to the direction of advance of the conveyor is less than the length of the strips.

3. An installation according to claim 1, wherein the spacer guides have narrow upstream ends and flare downstream in the direction of advance of the conveyor.

4. An installation according to claim 1, wherein the separation station includes:

transverse drive means suitable for exerting action on the profiled strips to displace them substantially perpendicularly to the direction of advance of the conveyor, and n series of stop means, n being an integer not less than 2, the first series being the series which, in the direction of advance of the transverse drive means is located furthest downstream in the separation station, while the nth series is the series which, in the same direction, is located furthest upstream in said station;

the stop means of two consecutive series being spaced apart from each other by a distance that is substantially equal to the width of a strip, the stop means of series 2 to n being suitable for occupying respective retracted positions in which they lie off the path of the strips through the separation station and respective active, abutment positions in which they lie on said path and are placed for co-operating with the strips;

n-1 actuator means for actuating the stop means of series 2 to n, for which, k being an integer in the range 1 to n-1, the kth actuator means is suitable for leaving the stop means of the k+1th series in the retracted position so long as no strip is present in the gap between the kth and the k+1th series, and for urging said stop means to take up their active, abutment position when a strip is in said gap; and longitudinal drive means suitable for acting on the strips to displace them parallel to the direction of advance of the conveyor and up to the conveyor, and takeover means suitable, when the strips are occupying their target positions in the separation stations, for causing the action of the transverse drive means on said strips to cease and for causing the action of the longitudinal drive means on said strips to begin.

5. An installation according to claim 4, wherein the actuator means are connected to strip presence detectors situated in each gap between two consecutive series of stop means, and comprise displacement means for displacing the stop means of each series between the retracted position and the active position, and control means for controlling said displacement means and connected to the presence detectors.

6. An installation according to claim 4, wherein the takeover means include a detector for detecting the presence of a strip upstream from the nth series of stop means.

7. An installation according to claim 1, including coordination means for coordinating the positions of the strips before they enter the print station, said coordination means comprising retractable front stop members suitable for taking up a retracted position in which they do not engage the strips, and an active, abutment position in which they are suitable for coming into abutment with the leading ends of the strips and in which the occupy determined positions relative to one another, said coordination means further comprising control means for controlling the front stop members to move them between the retracted and the active positions.

8. An installation according to claim 7, in which the print unit includes a rotary print cylinder, the installation including reference means for identifying at least one angular reference position of the print cylinder, and means for transmitting a reference signal to the means for controlling the front stop members.

9. An installation according to claim 8, wherein:

the coordination means include means for detecting the presence of strips in the region of the conveyor situated in the vicinity of and upstream from the front stop members when they are in the active position; and the coordination means further include means for transmitting to the control means for controlling the front stop members a detection signal as emitted by said detection means.

10. An installation according to claim 9, in which conveyor control means are provided for controlling the conveyor and suitable for causing the conveyor to advance and to stop, the installation including means for transmitting to said conveyor control means a detection signal emitted by the means for detecting the presence of strips, a reference signal emitted by the reference means, and a position flag signal concerning the retracted or active position of the front stop members, said conveyor control means being suitable for stopping the conveyor when the detection means detect the presence of strips while the front stop members are in the active position and for causing the conveyor to advance when, in the same situation, said control means receive a reference signal.

11. An installation according to claim 1, including guidance tweaking means in the region of the print station.

12. An installation according to claim 11, wherein:

the print station includes at least two print units disposed in succession in the direction of advance of the conveyor; and the guidance tweaking means are situated between the two print units.

* * * * *